United States Patent [19]

Hayashi et al.

[11] Patent Number: 4,697,820

[45] **Date of Patent: * Oct. 6, 1987**

[54] SKI

[75] Inventors: Keijiro Hayashi, Takatsuki; Kenzo Shinya, Gifu; Yasuo Saeki, Ohgaki; Shigeru Asai, Gifu, all of Japan

[73] Assignee: Mizuno Corporation, Osaka, Japan

[ * ] Notice: The portion of the term of this patent subsequent to Oct. 6, 2004 has been disclaimed.

[21] Appl. No.: 576,740

[22] Filed: Feb. 3, 1984

[30] Foreign Application Priority Data

Feb. 4, 1983 [JP] Japan ..... 58-17992

[51] Int. Cl.[4] ..... A63C 5/04

[52] U.S. Cl. ..... 280/609; 280/602; 280/610

[58] Field of Search ..... 280/609, 610, 601, 602, 280/817

[56] References Cited

U.S. PATENT DOCUMENTS

| | | | |
|---|---|---|---|
| 2,038,077 | 4/1936 | Haglund | 280/609 |
| 2,158,325 | 5/1939 | Hunt | 280/610 |
| 3,096,530 | 7/1963 | Almgren | 280/817 |
| 4,592,567 | 6/1986 | Sartor | 280/602 |

FOREIGN PATENT DOCUMENTS

| | | | |
|---|---|---|---|
| 901914 | 11/1944 | France | 280/610 |
| 1282053 | 12/1961 | France | 280/610 |
| 615499 | 1/1961 | Italy | 280/610 |
| 622973 | 7/1961 | Italy | 280/610 |

*Primary Examiner*—John J. Love
*Assistant Examiner*—Eric Culbreth
*Attorney, Agent, or Firm*—Fleit, Jacobson, Cohn & Price

[57] ABSTRACT

A ski comprises a ski upper-surface constituting member provided with at least one cut portion of any desired shape; and an upper-surface projection member defined by at least one upper-surface member and a reinforcing member which are separately formed, and having the shape of a roof whose ridge is defined by the widthwise central portion thereof. The upper-surface projection member is fitted and secured into the cut portion, thereby to form a roof-shaped projection on the upper-surface constituting member.

7 Claims, 16 Drawing Figures

SKI

BACKGROUND OF THE INVENTION

The present invention relates to an improvement in skis.

Skis have been made of wood, FRP, fiber reinforced metals and the like.

Wooden skis frequently used in the past were in a keel-like shape and had an intermediate portion which is thickened in order to maintain strength. Since such skis are heavy, bad in maneuverability and insufficient in flexural rigidity, however, they have gradually been replaced with tabular skis, which are made of FRP or metals and excellent in performance. Skis generally used now have such a shape that, as shown in FIG. 1, the thickness of a ski 1 gradually increases from the ski front end portion to the central portion and then gradually decreases from the central portion to the rear end portion. That is, both the front and rear parts are tapered, and the intermediate upper surface of the ski 1 is flat. On the other hand, sandwich structures are known in which, as shown in FIG. 2, reinforcing members 2 constituted by FRP plates or the like are disposed on the upper and lower surfaces of a core material or as a box structure in which a reinforcing member is disposed around the entire periphery of a core material.

These structures are generally employed by ski manufacturers, since they facilitate the ski manufacturing process.

In view of the physical properties of skis, however, it is exceedingly difficult to provide a design which gives an optimum balance of various interrelated properties, such as torsional strength, flexural strength, vibration damping property, air resistance and the like.

For example, if the torsional strength of a ski is improved, the flexural strength becomes higher to make the ski unfavorably rigid as well as to impair the vibration damping property, causing adverse effects on the sliding performance.

In addition, for reduction of the air resistance of a ski in sliding, a bore of any desired shape is opened in the shovel portion formed at the front end of a ski, or the rising degree of the shovel portion is decreased, thereby to suppress the air resistance as much as possible for increasing the speed in sliding. These methods, however, require much labor in the manufacturing process and a higher production cost.

Therefore, it has been desired to develop an improved ski having a proper elasticity, a high torsional strength, an excellent vibration damping property and a small air resistance value through a combination of materials having various properties. Although various research and development work has been carried out, no satisfactory ski has been proposed yet.

In view of the above-mentioned disadvantages of the prior art, it is an object of the invention to provide a ski excellent in slidability through an improvement of the ski in various properties, such as rigidity, torsional strength, vibration damping property, air resistance and the like, by replacing the conventional upper surface shape of the ski, which has been tabular, with such a shape that a roof-shaped projection is formed on the upper side of the ski.

BRIEF DESCRIPTION OF THE DRAWINGS

The invention will be described herein with reference to the accompanying drawings. As shown in FIGS. 3 to 10, the ski in accordance with the invention comprises: a ski upper-surface constituting member 4 provided with at least one cut out portion 6 of any desired shape; and an upper-surface projection member 5' constituted by an upper-surface member 7 and a reinforcing member 8, which are separately formed, and having the shape of a roof whose ridge is defined by the widthwise central portion thereof, the upper-surface projection member 5' being fitted and secured into the cut portion 6, thereby to form a roof-shaped projection 5 at a desired portion on the upper surface of the ski body and extending across a major portion of the width of the ski.

Since the ski of the invention is constructed as described above, it is possible to employ as the reinforcing member 8 of the upper-surface projection member 5', a fiber reinforced plastic material including any desired fiber, such as carbon fiber, glass fiber, boron fiber, silicon carbide fiber, alumina fiber, Aramid fiber, steel fiber and the like, or a metal material, such as an aluminum base alloy and a titanium base alloy, or such a material as a fiber reinforced thermoplastic and an engineering plastic, individually or in combination. Therefore, by selecting the material for the reinforcing member 8, it is possible to adjust, as desired, the individual properties (such as torsional strength, flexural strength, flexural rigidity, and vibration damping property) required for the ski itself. In consequence, it becomes possible to provide a ski having performance best suited for each class of skier, from the beginner class to the intermediate and advanced classes as well as the champion class, so that the ski is greatly increased in design freedom. Moreover, in the manufacture of the ski of the invention, the ski body (composed of a central core material, reinforcing member, steel edging and sliding surface member) is previously formed according to the design criteria, and, for example, a glass fiber reinforced plastic plate (referred to as simply "GFRP plate" hereinafter) is employed for the upper-surface constituting member 4 and a carbon fiber reinforced plastic plate (referred to as simply "CFRP plate", hereinafter) is employed for the upper-surface projection member 5'. As a result, the upper-surface constituting member 4 constituted by the GFRP plate is flexible and comparatively low in rigidity, but the part of the ski at the roof-shaped upper-surface projection member 5' constituted by the CFRP plate is high in both rigidity and torsional strength. Accordingly, the combination of these members makes it possible to provide a ski characterized in that the portion of the ski at the upper-surface projection member 5' is high in torsional rigidity and the other portion is rich in flexibility, a feature not possessed by conventional skis.

In particular, since the ski of the invention has the roof-shaped projection 5 formed on the upper-surface constituting member 4, unlike the conventional flat ski, the air flows along the projection 5 in sliding. Therefore, the ski is improved in directivity and at the same time, the front end portion of the ski is advantageously prevented from being lifted up, so that the sliding speed and the maneuverability are further improved.

Figure 1:
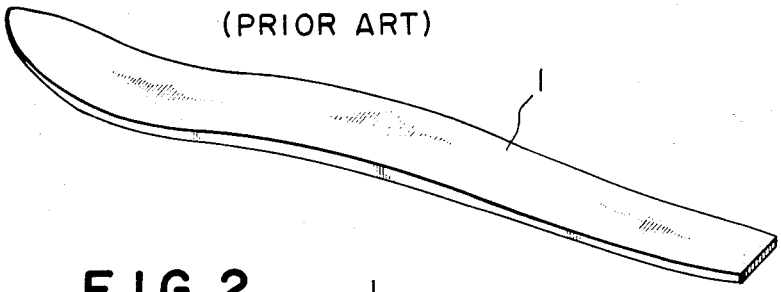
FIG. 1 (PRIOR ART)
FIG. 1 is a perspective view of a conventional ski.
Figure 2:
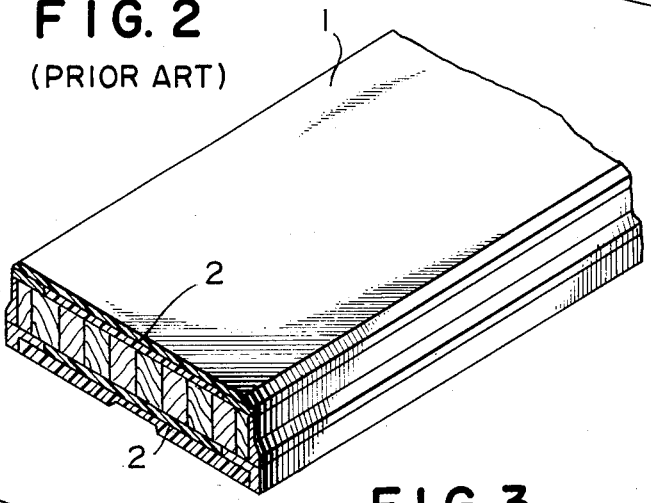
FIG. 2 (PRIOR ART)
FIG. 2 is a sectional perspective view of an essential part of a ski having a conventional sandwich structure.
Figure 3:
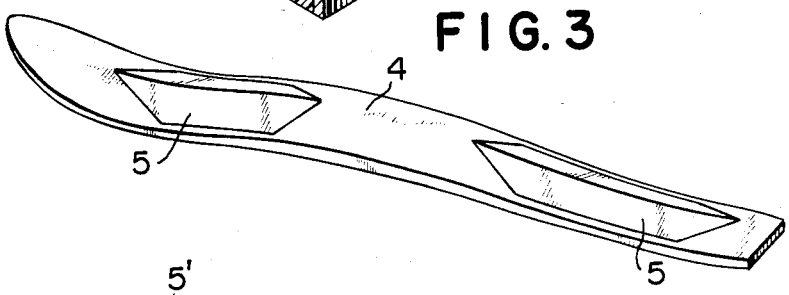
FIG. 3 is a perspective view of a ski in accordance with the invention.
Figure 4:
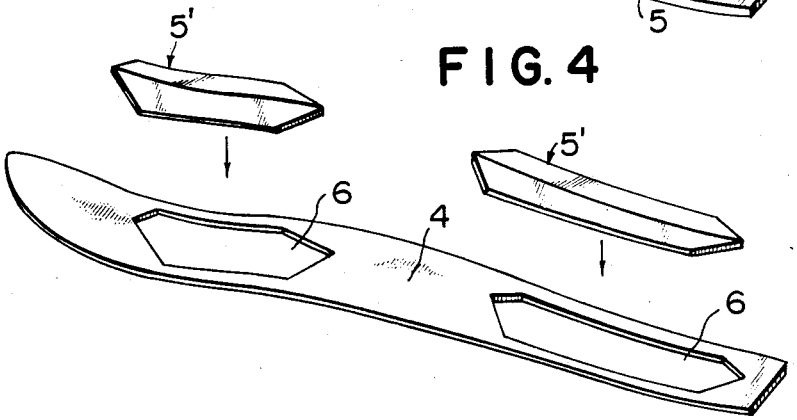
FIG. 4 is a perspective view showing how an upper-surface constituting member and roof-shaped upper-surface projection members of the ski shown in FIG. 3 are fitted with each other.
Figure 5:
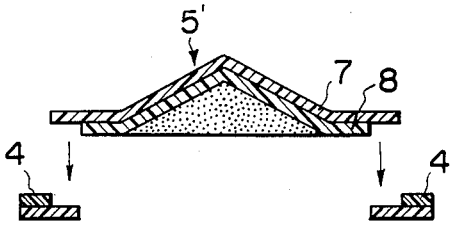
FIGS. 5, 6, 9, 13 and 14 are sectional views for illustrating how the upper-surface constituting member and the roof-shaped upper-surface projection members of the ski in accordance with the invention are fitted and secured to each other.
Figure 6:
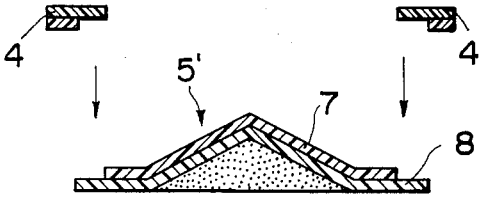
Figure 13:
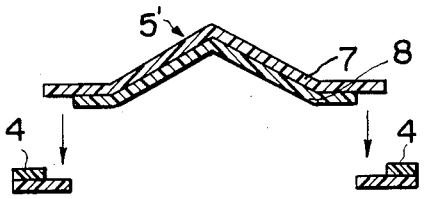
Figure 14:
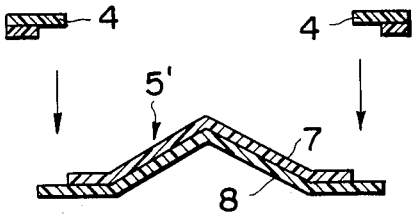

It is to be noted that when the roof-shaped upper-surface projection member 5' employed in the ski of the invention is separately formed, as shown in FIGS. 5 and 6, the upper-surface member 7, the reinforcing member 8 and he core material 9 can be formed in combination. Therefore, if a polyurethane elastomer foamed material, for example, is employed for the core material 9, the vibration damping property of the ski itself is greatly improved. As the core material 9, it is possible to select any desired material, such as wood and foamed synthetic resins. On the other hand, it is also possible to employ a roof-shaped upper-surface projection member 5' which is formed without any core material 9 interposed therein as shown in FIGS. 13 and 14.

Figure 7:
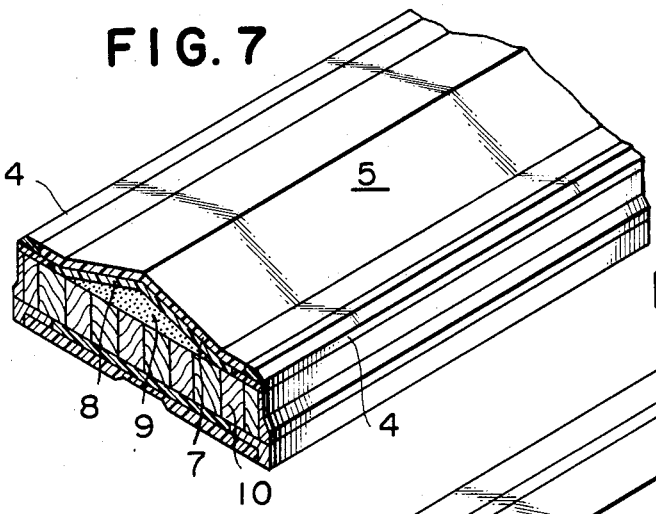
FIGS. 7, 8 and 10 are sectional perspective views of an essential part of the ski in accordance with the invention.
Figure 8:
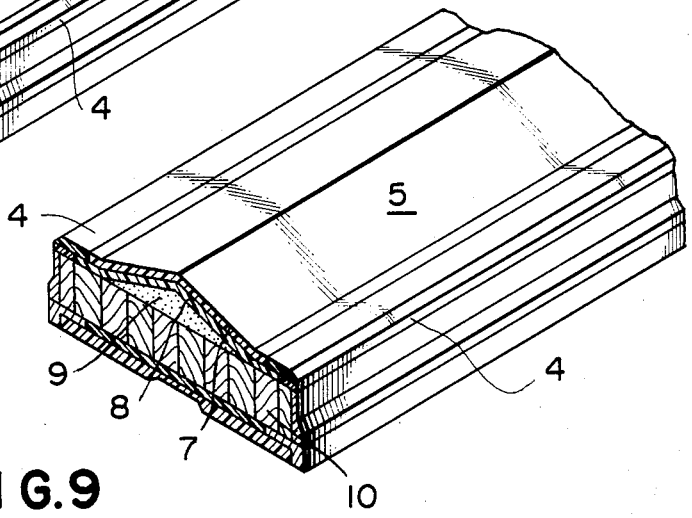
Figure 9:
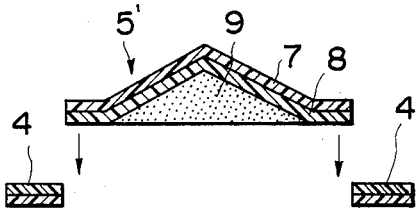
Figure 10:
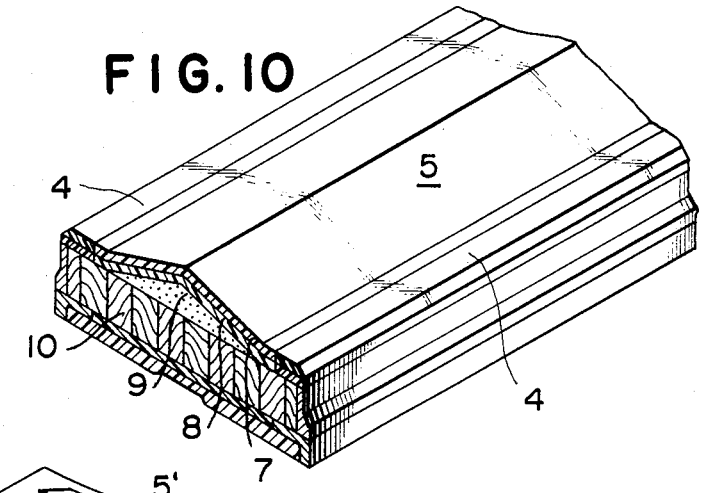
Figure 11:
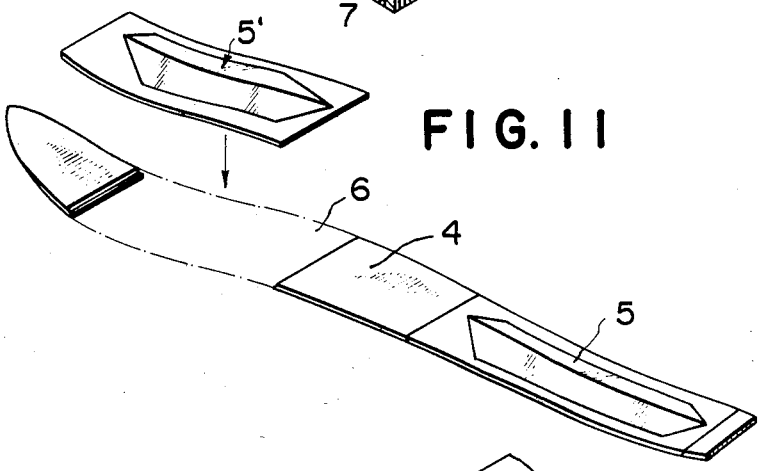
FIG. 11 is a perspective view showing how an upper-surface constituting member and roof-shaped upper-surface projection members of another embodiment of the invention are fitted with each other.
Figure 12:
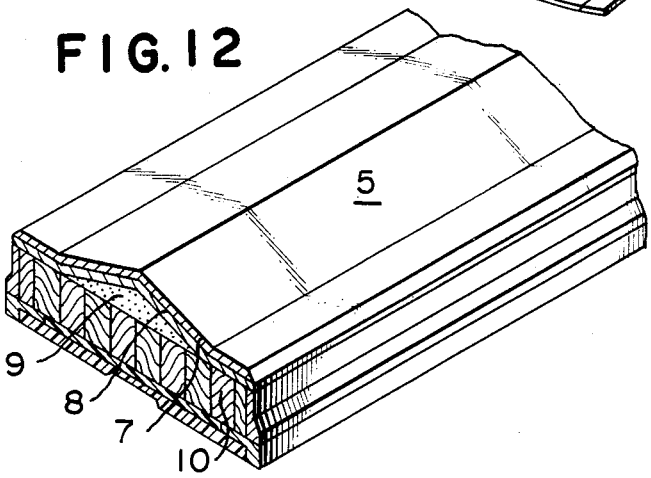
FIG. 12 is a sectional perspective view of an essential part of a ski in accordance with the embodiment shown in FIG. 11.

Examples of the method of fitting and securing the roof-shaped upper-surface projection member 5' into the cut portion 6 in the upper-surface constituting member 4 will now be described for reference. The examples include: a method wherein, as shown in FIGS. 5, 7 and 13, the cut portion in the upper-surface constituting member 4 is provided with step portions, and the upper-surface member 7 is formed so that its end portions fit the respective step portions, thereby to effect fitting and securing; a method wherein, as shown in FIGS. 6, 8 and 14, a cut portion formed in the upper-surface constituting member 4 is provided with step portions, and the reinforcing member 8 is formed so that its end portions fit the respective step portions, thereby to effect fitting and securing; and a method wherein, as shown in FIGS. 9 and 10, the upper-surface member 7 and the reinforcing member 8 are formed so as to be equal in shape to the cut portion in the upper-surface constituting member 4, thereby to fit and secure the members 7 and 8 into the cut portion. Further, there is a method wherein, as shown in FIGS. 11 and 12, the cut portion 6 in the upper-surface constituting member 4 is formed so as to extend over the entire width of the ski, and the roof-shaped upper-surface projection member 5' is formed on a flat plate which is coincident with the cut portion, thereby to fit and secure the upper-surface projection member 5' into the cut portion 6. In this case, if a metal plate of an aluminum base alloy, a titanium base alloy or the like is employed as the flat plate, which is coincident with the cut portion, then it becomes possible to form the roof-shaped upper-surface projection member 5' by means of pressing. Also, when a GFRP plate, CFRP plate or the like is employed, these plates can be formed extremely easily by means of a die.

Figure 15:
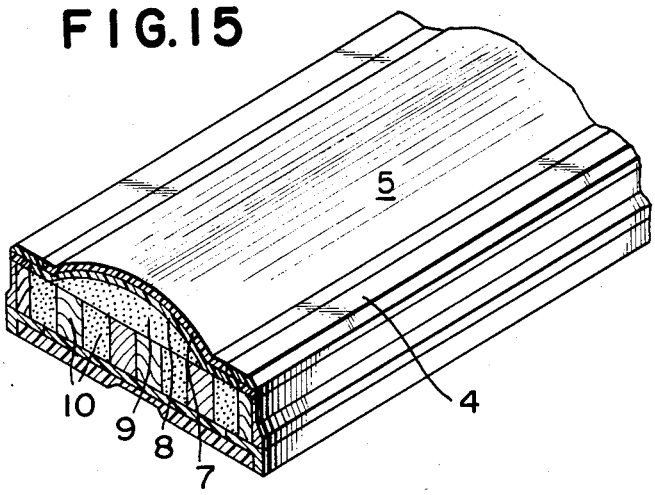
FIGS. 15 and 16 are sectional perspective views of essential parts of skis in accordance with other embodiments of the invention, respectively.
Figure 16:
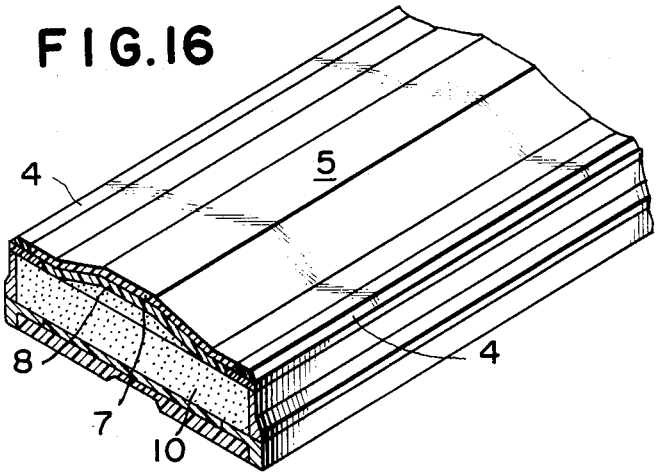

It is to be noted that the roof-shaped upper-surface projection member 5' in accordance with the invention may be formed, in cross-section, into an arched shape as shown in FIG. 15 or a trapezoidal shape as shown in FIG. 16. It has become clear as the result of tests that the upper-surface projection member 5' having the arched or trapezoidal cross-section improves the ski itself in torsional rigidity and flexural strength, and particularly, the upper-surface projection member 5' having the arched cross-section has an outstanding effect for preventing the adhesion of snow, while the upper-surface projection member 5' having the trapezoidal cross-section improves the ski in vibration damping property.

In addition, the roof-shaped projection 5 in accordance with the invention is disposed in front and at the rear of a binding mounting region or either in front or at the rear thereof. The length and shape of the projection 5 are selected at will so as to match properties required for each ski. Thus, it is possible to provide a ski designed in accordance with the technique of each skier.

What we claim is:

1. A ski comprising:

a ski upper-surface constituting member provided with two openings having a predetermined shape, said two openings being spaced from each other and being entirely spaced inwardly from an outermost periphery of said ski upper-surface constituting member; and two upper-surface projection members each including an upper-surface member and a reinforcing member underlying and in contact with said upper surface member, the rigidity of said two upper surface projection members being greater than the rigidity of said ski upper-surface constituting member and said two upper surface members each having an upwardly extending surface in the shape of a roof whose ridge is defined by the widthwise central portion thereof and that slopes downwardly and outwardly from a longitudinal center line of said ski, said upper-surface projection members have a periphery corresponding to and received in and substantially filling said two openings and secured into said two openings with said upwardly extending surface projecting outwardly therefrom and extending across a major portion of the width of the ski, thereby to form a roof-shaped upward projection on said upper-surface constituting member to provide improved rigidity.

2. A ski according to claim 1, wherein said roof-shaped upper-surface projection member includes a core member underlying said reinforcing member.

3. A ski according to claim 1, wherein said ski includes a ski binding mounting region spaced inwardly from longitudinal ends of the ski and on said upper-surface constituting member, and said two upper surface constituting members each being located in one of said two openings located forward and rearward of said ski binding mounting region and upper surface projection members received in and extending through each of said two openings to form a pair of longitudinally spaced roof shaped projections on said upper surface constituting member.

4. A ski according to claim 1 wherein said upper-surface constituting member includes laterally extending flat surfaces along the outer side edges thereof adjacent said two openings and extending to said outermost periphery.

5. A ski according to claim 1 wherein said roof-shaped projection is defined by planar surfaces.

6. A ski according to claim 1 wherein said projection is defined by a curved area in transverse cross section.

7. A ski according to claim 1 wherein said projection has a trapezoidal transverse cross section.

* * * * *